US010676675B2

(12) United States Patent
Thakur et al.

(10) Patent No.: US 10,676,675 B2
(45) Date of Patent: Jun. 9, 2020

(54) METHOD AND HARDWARE FOR SUPPLYING ADDITIVES TO THE DELAYED COKER DRUM

(71) Applicant: INDIAN OIL CORPORATION LIMITED, Kolkata, West Bengal (IN)

(72) Inventors: Ram Mohan Thakur, Faridabad (IN); Pradeep Ponoly Ramachandran, Faridabad (IN); Terapalli Hari Venkata Devi Prasad, Faridabad (IN); Gautam Thapa, Faridabad (IN); Debasis Bhattacharyya, Faridabad (IN); Brijesh Kumar, Faridabad (IN); Santanam Rajagopal, Faridabad (IN)

(73) Assignee: INDIAN OIL CORPORATION LIMITED, Kolkata (IN)

( * ) Notice: Subject to any disclaimer, the term of this patent is extended or adjusted under 35 U.S.C. 154(b) by 437 days.

(21) Appl. No.: 15/393,154

(22) Filed: Dec. 28, 2016

(65) Prior Publication Data

US 2017/0158963 A1 Jun. 8, 2017

Related U.S. Application Data

(63) Continuation of application No. 14/048,797, filed on Oct. 8, 2013, now abandoned.

(30) Foreign Application Priority Data

Oct. 8, 2012 (IN) ..... 2945/MUM/2012

(51) Int. Cl.
*C10B 1/04* (2006.01)
*C10B 3/00* (2006.01)
(Continued)

(52) U.S. Cl.
CPC ..... *C10B 57/12* (2013.01); *B05B 12/081* (2013.01); *C10B 1/04* (2013.01); *C10B 55/00* (2013.01); *C10B 3/00* (2013.01)

(58) Field of Classification Search
CPC ..... C10B 55/02; C10B 55/00; C10B 55/04; C10B 55/06; C10B 55/08; C10B 55/10;
(Continued)

(56) References Cited

U.S. PATENT DOCUMENTS 2,963,418 A 12/1960 Weinberg et al.
4,378,288 A 3/1983 Shih et al.
(Continued)

*Primary Examiner* — Jonathan Luke Pilcher
(74) *Attorney, Agent, or Firm* — Maschoff Brennan

(57) ABSTRACT

An apparatus for supplying additives into a coker drum includes an inlet for supplying a hydrocarbon feed stream into the coker drum and conduits along the circumference of walls of the coker drum. Each conduit has an injection nozzle to supply additives inside the coker drum. An injection control system controls the operation of the injection nozzles such that 1) one or more of the injection nozzles placed within a first distance above a vapour liquid interphase of the hydrocarbon feed stream are configured to supply the additives; and 2) supply of the additive discontinues from a particular injection nozzle when a distance between the injection nozzle and the vapour liquid interphase is less than or equal to a second distance. The apparatus optionally includes a mechanical drive system moving at least one of the conduits based on the level of the vapour liquid interphase in the coker drum.

15 Claims, 5 Drawing Sheets

(51) Int. Cl.

| | |
|---|---|
| ***C10B 55/00*** | (2006.01) |
| ***C10B 57/12*** | (2006.01) |
| ***B05B 12/08*** | (2006.01) |

(58) Field of Classification Search
CPC .... C10B 1/04; C10B 3/00; C10B 3/02; C10B 57/12; C10G 9/005
See application file for complete search history.

(56) References Cited

U.S. PATENT DOCUMENTS

| | | | | |
|---|---|---|---|---|
| 4,642,175 | A | 2/1987 | Rudnick | |
| 4,756,819 | A | 7/1988 | Bousquest et al. | |
| 5,006,223 | A | 4/1991 | Wiehe et al. | |
| 5,041,207 | A | 8/1991 | Harrington et al. | |
| 5,110,449 | A * | 5/1992 | Venardos | C10B 55/00 201/25 |
| 5,200,061 | A * | 4/1993 | Viscontini | C10B 39/04 208/131 |
| 5,492,617 | A | 2/1996 | Trimble et al. | |
| 2002/0179493 | A1 * | 12/2002 | Etter | C10B 55/00 208/131 |
| 2007/0108036 | A1 | 5/2007 | Siskin et al. | |
| 2009/0209799 | A1 | 8/2009 | Etter et al. | |
| 2009/0220620 | A1 | 9/2009 | Dickinson et al. | |
| 2010/0174130 | A1 | 7/2010 | Spicer et al. | |
| 2010/0252409 | A1 | 10/2010 | Lah | |

* cited by examiner

METHOD AND HARDWARE FOR SUPPLYING ADDITIVES TO THE DELAYED COKER DRUM

RELATED APPLICATIONS

This application is a continuation of U.S. patent application Ser. No. 14/048,797, filed Oct. 8, 2013, which claims priority to Indian Patent Application No. 2945/MUM/2012, filed Oct. 8, 2012. The foregoing applications are incorporated herein by reference.

FIELD OF INVENTION

The present invention relates to a delayed coking process used in petroleum refineries wherein heavy hydrocarbon petroleum residue is thermally cracked to obtain liquid and gaseous product streams and leaving behind solid, carbonaceous petroleum coke. Particularly, the invention relates to a hardware and method for supplying additives into the delayed coker unit.

BACKGROUND OF THE INVENTION

In the recent years, there has been a constant increase in the tendency of petroleum refiners to implement delayed coking process as part of their overall operation of processing of the crudes, because of the advantages it is known to provide. Further, with the crude sources becoming heavier or with the more refiners switching to processing "opportunity crudes" (also referred in the industry as challenging crudes), it is anticipated that more interest will be shown in delayed coking processes. In Delayed Coker Unit (DCU), a heavy hydrocarbon feedstock is fed to a furnace, which heats the feedstock to the desired coking temperature and is designed and controlled to prevent premature coking in the heater tubes. The hot feedstock is then passed from the heater to one or more coker drums where the hot material is held for an extended period of time at desired pressure, until coking reaction completes. Vapors from the drums are fed to a fractionator where gas, naphtha, and gas oils are separated out. The heavier hydrocarbons obtained in the fractionator are recycled through the furnace as per the requirement. After the coke reaches a predetermined level in one drum, the feed flow is diverted to another coker drum to maintain continuous operation. The coked drum (i.e. coker drum having coke upto the predetermined level) is steamed to strip out entrapped hydrocarbons, cooled by water injection and decoked by mechanical or hydraulic methods.

Recently in prior art, a number of inventions have come up in the area of delayed coking process, that suggest addition of some external additive(s)/chemicals to the coker feedstock in order to meet various objectives like reduction of coke yield, improving the quantity as well as quality of liquid and gaseous products and improving the quality of coke produced. By way of example, U.S. Pat. No. 4,378,288 describes a method for increasing the distillate yield in delayed coking process by adding a free radical inhibitor to the coker feed material. U.S. Pat. No. 4,642,175 describes a process for upgrading the heavy hydrocarbon feedstock by reducing the coking tendency by contacting with free radical removing catalyst. U.S. Pat. No. 4,756,819 tries to prevent the coke formation in thermal treatment of heavy hydrocarbon residues by use of a metallic salt in the form of suspension of solid particles, in solution or as emulsion. U.S. Pat. No. 5,006,223 describes a method of increasing the thermal conversion of hydrocarbons without any substantial increase in gaseous products formed, by the addition of certain free radical initiators.

In the aforesaid documents, the additives are added to the feedstock at a stage before the feedstock is fed to the coker drum. Residence time of the additive in the process is increased by incorporation of the additives in the feedstock before the same is fed to the coker drum. This may lead to reduction in activity of the additive. Moreover, the presence of additives in the furnace tubes may lead to increase in the possibility of coke deposition on the metal surface.

Reference may be made to U.S. Patent Publication No. 2009/0209799 that describes a process in which the hydrocarbons are cracked or coked by adding an additive into the vapors emerging from the coker drum or coking vessel. Particularly, the document describes methods for injecting the additives into the vapor phase at an upper portion of the coker drum. It is felt that since the coking reactions predominantly take place in the liquid pool such a procedure may not be providing the best results. Thus, there exits a need to improvise the delayed coking process used in petroleum refineries for one or more of the following objectives (a) reduction of coke yield, (b) improving the quality and quantity of liquid and gaseous products or (c) improving the quality of coke produced, including coke morphology.

SUMMARY OF THE INVENTION

The present invention describes a delayed coking process useful in petroleum refineries wherein heavy hydrocarbon petroleum residue is thermally cracked to obtain liquid and gaseous product streams and leaving behind solid, carbonaceous petroleum coke, said process comprising adding one or more external additive(s)/chemicals to the coker feedstock maintained in a delayed coker drum at the vapor liquid interphase.

An apparatus for supplying additive(s) into a coker drum is disclosed. The apparatus comprises an inlet for supplying a hydrocarbon feed stream into the coker drum and a plurality of conduits arranged along the circumference of walls of the coker drum, each of the plurality of the conduits is provided with an injection nozzle to supply additives inside the coker drum. The apparatus further comprises an injection control system for controlling the operation of the plurality of injection nozzles such that 1) one or more of the injection nozzles placed within a first predetermined distance in a first direction above a vapour liquid interphase of the hydrocarbon feed stream are configured to supply the additives; and 2) supply of the additive discontinues from a particular injection nozzle when a distance in the first direction between the injection nozzle and the vapour liquid interphase is less than or equal to a second predetermined distance. The apparatus optionally includes a mechanical drive system for moving at least one of the plurality of conduits based on the level of the vapour liquid interphase of hydrocarbon feed stream in the coker drum. Further, the injection nozzles located at a distance greater than the first predetermined distance are controlled so as to supply steam. Also, the injection nozzles located at a distance less than the second predetermined distance are controlled so as to supply steam.

A method for supplying additive(s) into a coker drum is also disclosed. The method comprises supplying a hydrocarbon feed stream into coker drum and supplying additives through a plurality of conduits arranged along the circumference of walls of the coker drum, each of the plurality of the conduits being provided with an injection nozzle for supplying additives inside the coker drum. The method further includes controlling the operation of the plurality of injection nozzles, including the steps of configuring one or more of the injection nozzles placed within a first predetermined distance in a first direction above a vapour liquid interphase of the hydrocarbon feed stream to supply the additives and discontinuing the supply of the additive from a particular injection nozzle when a distance in the first direction between the injection nozzle and the vapour liquid interphase is less than or equal to a second predetermined distance. The method optionally includes the step of optionally moving at least one of the plurality of conduits based on the level of the vapour liquid interphase of hydrocarbon feed stream in the coker drum. The method further includes controlling the injection nozzles located at a distance greater than the first predetermined distance to supply steam. Further, the method includes controlling the injection nozzles located at a distance less than the second predetermined distance to supply steam. In the case where vertical movement of conduits are possible, the plurality of conduits may be placed such that their injection nozzles are at same elevation and the additive injection control system will be such that 1) plurality of conduits to be placed inside the coker drum such that the tips of injection nozzles are kept within a first predetermined distance from the bottom of the coker drum 2) all injection nozzles to start supplying additive when the supply of hydro carbon feed stream to the coker drum starts 3) all conduits to be moved vertically upwards in a way such that tips of injection nozzles to be placed within a first predetermined distance in the first direction above vapour liquid interphase of the hydrocarbon feed stream 4) additive supply to all injection nozzles to discontinue and steam flow to start as the level of vapour-liquid interphase reaches up to around 75% of coker drum height.

In yet another embodiment, an apparatus for Supplying additive into a coker drum is disclosed. The apparatus includes an inlet for Supplying hydrocarbon feed stream and a plurality of injection nozzles located at varying elevations into the walls of the coker drum. The apparatus further includes an injection control system configured to control the operation of the plurality of injection nozzles, such that 1) one or more of the injection nozzles placed within a first predetermined distance in a first direction along an axial-direction of the coker drum and above a vapour liquid interphase of the hydrocarbon feed stream are configured to supply the additives; 2) supply of the additive discontinues from a particular injection nozzle when a distance in the first direction between the injection nozzle and the vapour liquid interphase is less than or equal to a second predetermined distance; and 3) one or more of the injection nozzles placed after a third predetermined distance in a second direction opposite to the first direction and along the vapour liquid interphase are configured to supply steam. Further, the nozzles that are not Supplying additives at a particular time may be configured to Supply steam. In other words, all the nozzles may be configured to Supply steam other than the nozzle supplying the additives. In the most preferred embodiment, the switch over from the supply of the additive to steam may be a simultaneous operation.

BRIEF DESCRIPTION OF THE DRAWINGS

The attached figures show various aspects of the process of the present invention. Numbering adopted in the drawings is unique to each figure given.

Figure 1:
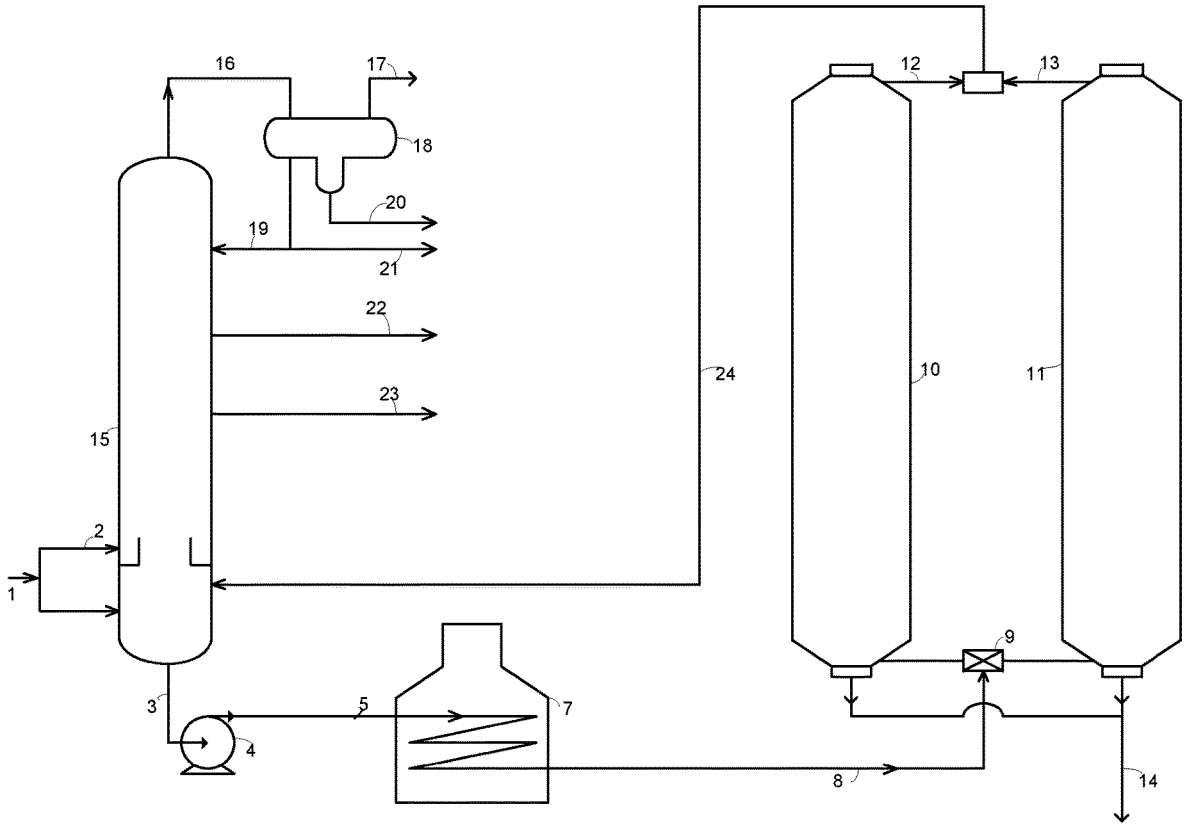
FIG. 1 shows the basic flow diagram of the Delayed coking process of the known art.

Further, skilled artisans will appreciate that elements in the drawings are illustrated for simplicity and may not have been necessarily been drawn to scale. For example, the dimensions of some of the elements in the drawings may be exaggerated relative to other elements to help to improve understanding of aspects of the present invention. Furthermore, the one or more elements may have been represented in the drawings by conventional symbols, and the drawings may show only those specific details that are pertinent to understanding the embodiments of the present invention so as not to obscure the drawings with details that will be readily apparent to those of ordinary skill in the art having benefit of the description herein.

DESCRIPTION OF THE INVENTION

While the invention is susceptible to various modifications and alternative forms, specific embodiment thereof has been shown by way of example in the drawings and will be described in detail below. It should be understood, however that it is not intended to limit the invention to the particular forms disclosed, but on the contrary, the invention is to cover all modifications, equivalents, and alternative falling within the spirit and the scope of the invention.

The parts of the device have been represented where appropriate by conventional symbols in the drawings, showing only those specific details that are pertinent to understanding the embodiments of the present invention so as not to obscure the disclosure with details that will be readily apparent to those of ordinary skill in the art having benefit of the description herein.

The terms "comprises", "comprising", or any other variations thereof, are intended to cover a non-exclusive inclusion, such that a process, method that comprises a list of steps does not include only those steps but may include other steps not expressly listed or inherent to such process, method. Similarly, one or more elements in a system or apparatus proceeded by "comprises . . . a" does not, without more constraints, preclude the existence of other elements or additional elements in the system or apparatus.

Accordingly, the present invention describes a delayed coking process useful in petroleum refineries wherein heavy hydrocarbon petroleum residue is thermally cracked to obtain liquid and gaseous product streams and leaving behind solid, carbonaceous petroleum coke, said process comprising adding one or more external additive(s)/chemicals to the coker feedstock maintained in a delayed coker drum at the vapor liquid interphase. In addition to the above, the present invention describes at least one novel hardware that facilitates implementation of the aforesaid method.

The present invention relates to a thermal cracking process, where heavy petroleum residue are thermally cracked and converted into liquid and gaseous product streams and leaving behind solid, carbonaceous petroleum coke. Referring to FIG. 1, a preheated residual heavy hydrocarbon feedstock (1) is fed into the fractionator bottom (15), where it combines with the condensed recycle and pumped out from fractionator (3) bottom. The hydrocarbon feedstock exiting from the fractionator bottom is pumped (4) through a coker heater (7), where the desired coking temperature is achieved, causing partial vaporization and mild cracking. A vapor liquid hydrocarbon mixture (8) exits the heater and a control valve (9) diverts it to a coking drum (10). Sufficient residence time is provided in the coking drum to allow thermal cracking till completion of coking reactions. The vapor liquid mixture is thermally cracked in the drum to produce lighter hydrocarbons (12), which vaporize and exit the coker drum (10). The drum vapor line temperature is the measuring parameter used to represent the average drum outlet temperature. Quenching media like gas oil or slop oil is typically added to the vapor line (24) to quench vapors to avoid coke formation in the vapor line. When coke in the coker drum (10) reaches the defined level, the coking cycle ends and the heater outlet charge is then switched from one drum (10) to a other parallel coker drum (11) to initiate its coking cycle, while the filled drum (10) undergoes a series of steps like steaming, water cooling, coke cutting, vapor heating and draining. The liquid (14) draining from the drums is fed to the blow down section. The cracked hydrocarbon vapors (24) are transferred to fractionator bottom, where they are separated and recovered. Coker heavy gas oil (HGO) (23), Coker light gas oil (LGO) (22) etc. are drawn off the fractionator at desired boiling temperature ranges. The fractionator overhead stream, wet gas (16) goes to separator (18), where it is separated into gaseous hydrocarbons (17), water (20) and unstabilized naphtha (21). A reflux fraction (19) is returned to the fractionator.

The liquid hydrocarbon feedstock to be used in the process can be selected from heavy hydrocarbon feedstocks like vacuum residue, atmospheric residue, deasphalted oil, shale oil, coal tar, thermal pyrolytic tar, visbreaker streams, clarified oil, slop oil or blends of such hydrocarbons. The Conradson carbon residue content of the feedstock can be a minimum of 5 wt. % and preferably may vary from 5 wt. % to 27 wt. %. Feedstock used in the process can have a minimum density of 0.9 g/cc. These hydrocarbon feedstocks may or may not be hydro-treated for removal of sulfur and metals before feeding into the process, depending on the requirement.

Coking reactions predominantly take place in the liquid pool formed inside the coker drum or coking vessel due to the supply of hydrocarbon feedstock into the drum. The method disclosed in the present invention includes the supply of the additive(s)/chemicals at the vapor-liquid interphase inside the coker drum or coking vessel, instead of supplying them along with feed or supplying the additive from the top to the vapors emerging from the coker drum or coking vessel. The vapor liquid interphase inside the coker drum is in a highly turbulent state with vigorous mixing of gas and liquid. The injection of additive(s)/chemicals into the vapor liquid interphase is having the following advantages:

1. Minimizing carryover of additive(s)/chemicals with the overhead vapor stream leading to effective utilization of the additive(s)/chemicals
2. Minimizing contamination of liquid and gaseous products, resulting in trouble free downstream operations
3. Efficient mass transfer between hydrocarbon and additive(s)/chemicals due to turbulence and mixing at the vapor liquid interphase The additive(s)/chemicals or mixture of additive(s)/chemicals supplied can be in gaseous, liquid, solid, emulsion state or a mixture of the same. The non limiting examples of additives to be used for the process include, cracking catalysts, free radical removing catalysts, hydrogen donors, fuel gas, free radical generators, asphaltene stabilizers and/or a combination of the same. There can be a carrier fluid supplied along with the additive(s)/chemicals which can be in gaseous, liquid, solid, emulsion state or a mixture of the same. The non limiting examples of the carrier fluid are hydrocarbon liquids of suitable boiling range including the feedstock, residue, lighter hydrocarbons, gas oil, solvents, water, steam, nitrogen, inert gases, fuel gas, carbon monoxide, carbon dioxide and/or the like.

Figure 2:
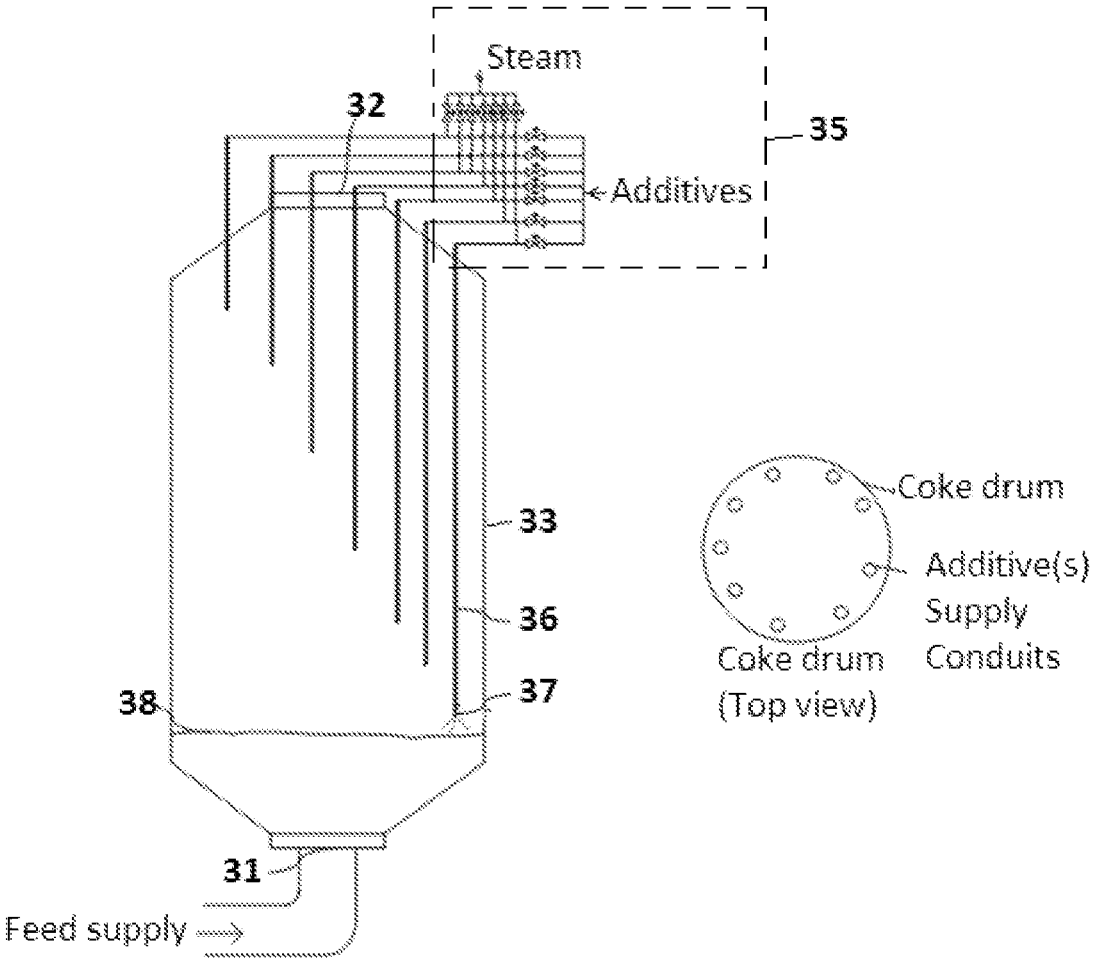
FIG. 2 shows the hardware for injecting the additive(s) into the coker drum in accordance with a first option disclosed in the present invention.

In accordance with a first option, the hardware to facilitate supply of additive(s) into the coker drum is shown in FIG. 2. In this embodiment, the preheated hydrocarbon feed stream (31) is supplied from the bottom of the coker drum (33), where it undergoes cracking to form various lighter products and coke. However, it may be noted that the hydrocarbon stream may be supplied through inlets at other locations of the coker drum as well. Lighter hydrocarbon molecules are carried over out of the coker drum in the overhead vapor stream (32). A plurality of conduits (36) is placed inside the coker drum (33) around the circumference of the walls of the coker drum (33). Each of the plurality of the conduit (36) is provided with an injection nozzle (37) for injection of additive(s)/chemical(s) with/without carrier fluid. The additive(s)/chemicals are supplied to the surface/interphase (38) of the liquid material inside the coker drum (33) through the injector nozzles (37). Injection of additive (s)/chemicals(s) to the injection nozzles (37) is controlled through an injection control system (35) in such a way that the injection nozzles placed above the vapour liquid inter phase of the hydrocarbon feed stream are configured to supply the additive. Generally, one or more of the injection nozzles placed within a first predetermined distance in a first direction along the axial-direction of the coker drum and above the vapour liquid interphase of the hydro carbon feed stream, are configured to supply the additives. The first predetermined distance is preferably the product of a multiplication factor (n) and the distance between two consecutive nozzles. However, the distance may be optimized depending upon the system requirements by a person skilled in the art. As the vapor liquid interphase level inside the drum (33) increases and reaches near the location of a given injecting nozzle (37) by less than 0.01 m or any second predetermined distance, injection control system (35) dis continues the supply of the additive from that injection nozzle (37) and switch over to supply of steam.

According to a preferred embodiment, the number of conduits in the coker drum (33) ranges from 2-12, depending on coker drum diameter, such that the conduits (36) are placed within a radial distance of 5-30 percent of the radius from the wall of the coker drum (33), and more preferably 20 percent. Preferably, the conduits (36) are placed at varying elevations. The supply of the additives generally begins through the injection nozzle of the conduit at the lowest elevation. However, a certain number of conduits (36) may also be placed at the same elevation depending upon the requirements. In an alternate embodiment, the conduits may be connected to a mechanical drive system (not shown) to enable vertical and rotatory movement of conduits. Preferably, at a particular instant, only one injection nozzle placed in vicinity above the vapour liquid interphase is configured to supply the additive. However, more than one injection nozzle placed in vicinity above the vapour liquid interphase may be configured to supply the additive simultaneously. The preferable predetermined distance, at which the supply of the additive discontinues from one injection nozzle and switches to another injection nozzle in the elevation, is less than 0.01 m. The conduits not being used to supply additives at a particular instant may be used to supply steam or any other chemical based on the requirements. The injection control system may comprise of a microcontroller or a processor or any suitable control means to control switching off the supply of the additive from the injection nozzle that go below the vapour liquid interphase and the supply steam through them. The passing of the steam in this manner helps to create more number of channels through the coke bed. The creation of the additional channels through the coke bed has the following advantages:

1. Additional channels can later be used for supply of additional cooling agents/chemical agents for modification of coke property like sulfur reduction;
2. Allow increased contact of quenching (cooling) water and the coke during coke quenching step, leading to faster cooling of coke bed and thereby reducing the cooling time; and
3. Effectively reduces the bed density of the deposited coke, making it easier to cut and remove the coke in less time.

Guides (not shown) are provided at the inner surface of the coker drum to hold the conduits in their position. Metallurgy of the conduit, injection nozzle, guide plates etc. shall be suitable for the conditions prevailing in the coker drum. The additive(s)/chemicals or mixture of additive(s)/chemicals supplied can be in gaseous, liquid, solid, slurry, foam, emulsion state or a mixture of the same. There can be a carrier fluid supplied along with the additive(s)/chemicals(s) which can be in gaseous, liquid, solid, emulsion state or a mixture of the same. The additives may be added in isolation or along with a carrier fluid. The non-limiting examples of the carrier fluid are hydrocarbon liquids of suitable boiling range which may include the feedstock, gas oil, lighter hydrocarbons, residue, solvents, water, steam, nitrogen, inert gases, carbon monoxide, carbon dioxide and/or the like. In case of blockage Steam or Nitrogen or other hydrocarbon gases or liquids like water, naphtha, gasoil, fuel oil, purge oil etc. can be used to clean the injection nozzles.

The diameter and length of the supply conduit can be determined based on the flow rate of the additives or additives along with carrier fluid to be supplied into the coker drum, with the length being limited by the elevation of the coker drum. The material of construction of the supply conduit can be selected based on the operating conditions like temperature and pressure prevailing inside the coker drum. The carrier fluid and the additive material can have a different temperature than the hydrocarbon feedstock entering the coker drum.

Figure 3:
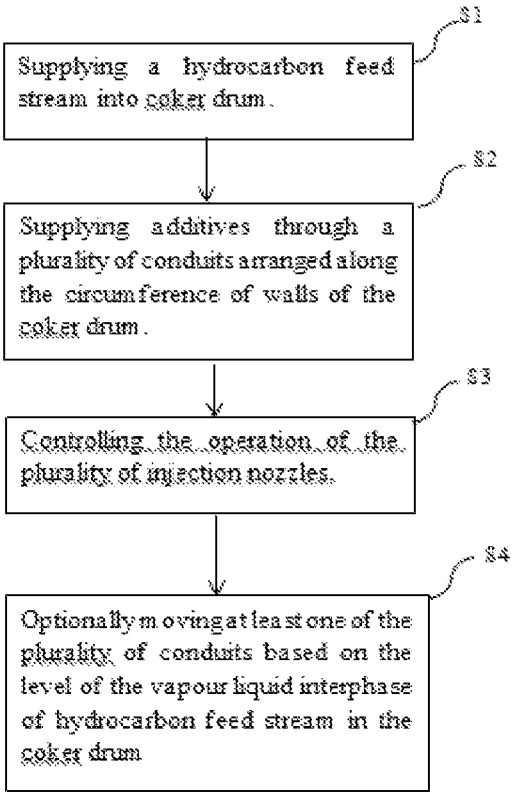
FIG. 3 shows the flowchart illustrating the steps involved in the method of the present invention.

Referring to FIG. 3, a method for supplying additive(s) into a coker drum (33) is also disclosed. The method comprises supplying (step S1) a hydrocarbon feed stream into coker drum (33) and supplying additives (Step S2) through a plurality of conduits (36) arranged along the circumference of walls of the coker drum (33), each of the plurality of the conduits (36) being provided with an injection nozzle (37) for supplying additives inside the coker drum (33). The method further includes controlling (Step S3) the operation of the plurality of injection nozzles (37), including the steps of configuring one or more of the injection nozzles (37) placed within a first predetermined distance above a vapour liquid interphase of the hydrocarbon feed stream to supply the additives and discontinuing supply of the additive and starting supply of steam from a particular injection nozzle when a distance between the injection nozzle and the vapour liquid interphase is less than or equal to a second predetermined distance. The method optionally includes the step of moving (Step S4) at least one of the plurality of conduits (37) based on the level of the vapour liquid interphase of hydrocarbon feed stream in the coker drum.

Figure 4:
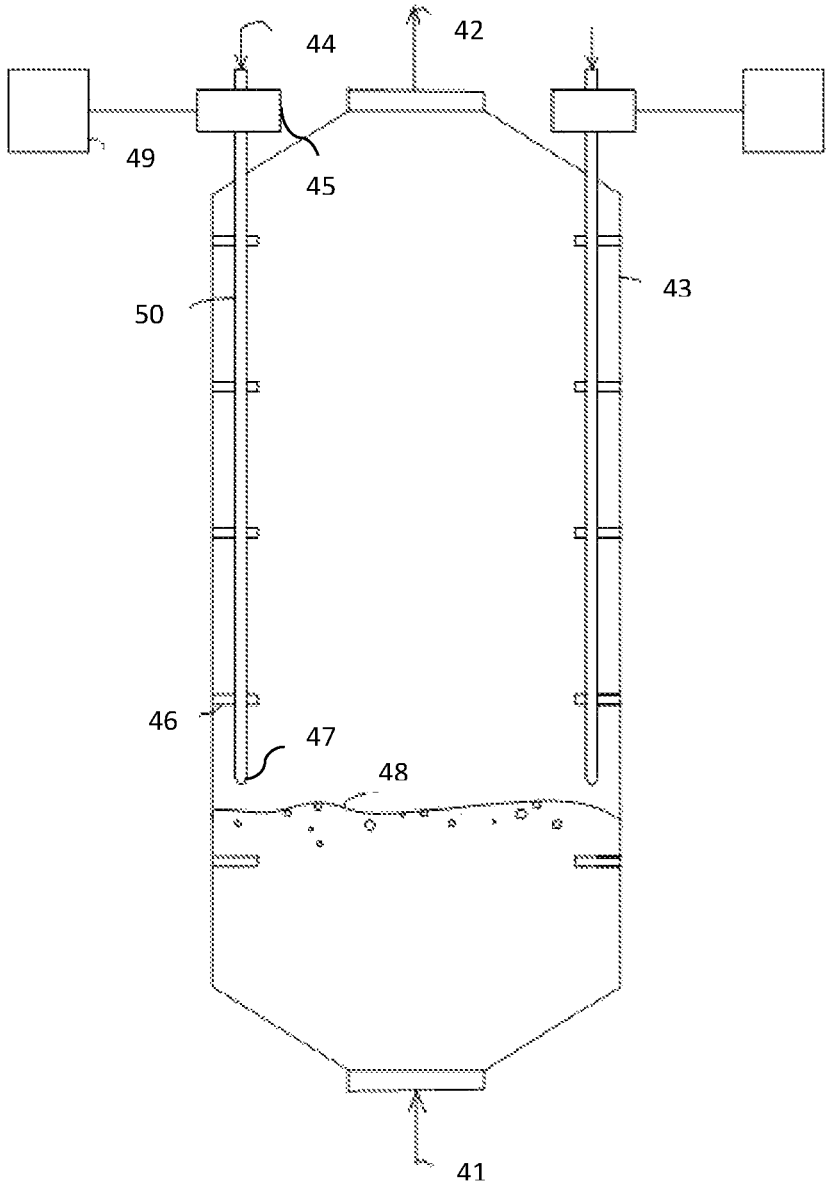
FIG. 4 shows the hardware for injecting the additive(s) into the coker drum in accordance with a second option disclosed in the present invention.

In accordance with a second option, the hardware to facilitate the supply of additive(s) into the coker drum is shown in FIG. 4. In this embodiment, the preheated hydrocarbon feed stream (41) is supplied from the bottom of the coker drum (43), where it undergoes cracking to form various lighter products and coke. Lighter hydrocarbon molecules are carried over out of the coker drum (43) in the overhead vapor stream (42). A conduit (46) is placed inside the coker drum (43) near the periphery, which enters the drum (43) through a nozzle in the top section and the same has at its end, an injector nozzle (47) for injection of additive(s)/chemical(s) with/without carrier fluid. The additive(s)/chemicals are supplied to the surface/interphase (48) of the liquid material inside the drum (43) through the injector nozzle (47). A mechanical drive system (45), connected to an electrical power supply (49) is provided to the additive(s)/chemicals supply conduit, which enables the vertical movement of the conduit (46). The movement rate of the conduit (46) will be controlled by an automated guide system. The movement rate of the conduit (46) is to be normally kept such as; the tip of the conduit (46) is just above the vapor liquid interphase by an elevation of minimum by 0.01 m to 0.8 m, and preferably 0.5 m, which shall be determined based on the hydrocarbon feed rate into the coker drum (43). Guides are provided at the inner surface of the coker drum to hold the conduit (46) in its position and facilitate the rotation of the conduit (46) along its own axis and also its upward/downward movement.

The rate of movement of the vertically movable additive supply conduit (46) with injection nozzle (47) at the end, is normally kept such as the tip of the conduit is above the vapor liquid interphase by an elevation of minimum by 0.01 m to 0.8 m, and preferably 0.5 m, which shall be determined based on the hydrocarbon feed rate into the coker drum (43), for supply of the additives into the vapor liquid interphase inside the drum (43). The additive supply conduit will be moved vertically in the upward direction with the increasing vapor-liquid interphase level inside the coker drum, keeping a minimum distance of 0.01 m to 0.8 m, and preferably 0.5 m between the vapor liquid interphase and the tip of the supply conduit. Additives supply can be continuous or as pulses.

Figure 5:
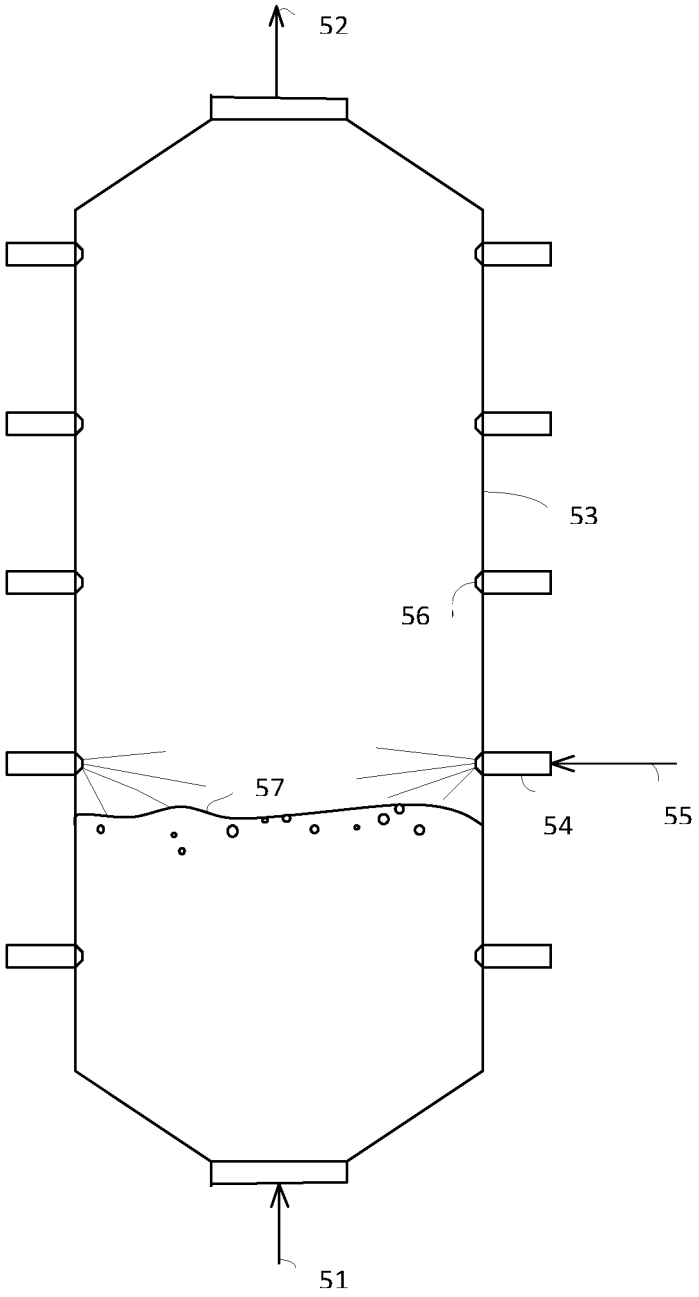
FIG. 5 shows the hardware for injecting the additive(s) into the coker drum in accordance with a third option disclosed in the present invention.

In accordance with a third option, the hardware to facilitate the supply of additive(s) into the coker drum is shown in FIG. 5. In this embodiment, the preheated hydro carbon feed stream (51) is supplied from the bottom of the coker drum (53), where it undergoes cracking to form various lighter products and coke. Lighter hydrocarbon molecules are carried out of the coker drum in the overhead vapor stream (52). A number of injector nozzles (56) are placed along the periphery of the coker drum wall at varying elevations, to inject additive(s)/chemicals(s) into the vapor liquid interphase (57) inside the drum. Additive(s)/chemicals along with/without carrier fluid are supplied to the injector nozzles through the inlet (55). Injection of additive (s)/chemicals(s) to the nozzles is controlled using an injection control system (not shown) in such a way that, that one or more of the injection nozzles (56) placed within a first predetermined distance in a first direction along the axial-direction of the coker drum and above the vapour liquid interphase of the hydrocarbon feed stream are con figured to supply the additives. The first predetermined distance is preferably the product of a multiplication factor (n) and the distance between two consecutive nozzles, wherein n is preferably greater than or equal to 1. However, the distance may be optimized depending upon the system requirements by a person skilled in the art. As the vapor liquid interphase level inside the drum increases and reaches near the location of a given injecting nozzle by less than 0.01 m, additive(s)/chemicals(s) flow to that particular nozzle is discontinued and switched over to the nozzles placed in the next level towards the top by an injection control system (not shown). Further, the nozzles that are not supplying additives at a particular time may be configured to supply steam. In other words, all the nozzles may be configured to supply steam other than the nozzle supplying the additives. In an embodiment, the injection control system switches the Supply of the additive to steam from the injection nozzles (56) when the distance between the injection nozzles (56) and the vapour liquid interphase is greater than a third predetermined distance along a second direction that is along the axial-direction of the coker drum and opposite to the first direction, and below the vapour liquid interphase of the hydrocarbon stream. The third predetermined distance is preferably in the range of 0.01 m to 0.1 m. In the most preferred embodiment, the switch over from the supply of the additive to steam may be a simultaneous operation. The injection control system may comprise of a microcontroller or a processor or any other suitable control means to control switching off the supply of the additive from the injection nozzle that go below the vapour liquid interphase and continue the supply of steam.

As the supply of hydrocarbon feedstock starts in the coker drum, the additive supply is started through the injection nozzle placed at the lowest elevation inside the coker drum. As the vapor-liquid interphase level inside the drum increases and reaches near the location of a given injecting nozzle at a vertical elevation by less than 0.01 additive(s)/chemicals(s) flow to that particular nozzle is discontinued and switched over to the injection nozzle placed at the next higher elevation. Additives supply can be stopped and steam supply can be started when the liquid/coke level reaches the maximum limit or at any desirable level inside the coker drum. The timings of starting and stopping of additive supply to the various injection nozzles can be determined based on the hydrocarbon feed rate and liquid/coke filling rate inside the coker drum. There can be more than one injector nozzle located at a given elevation inside the coker drum. The nozzles may be placed at any radial location at a given elevation. The orientation of the injector nozzle can vary from 45 to 135 degrees to the vertical drum wall. Metallurgy of the injection nozzle shall be in accordance to process conditions and material coming into contact with it. The passing of the steam in such manner into the coker drum has several advantages as has been discussed before and are not being repeated again herein.

The additive(s)/chemicals or mixture of additive(s)/chemicals supplied can be in gaseous, liquid, solid, slurry, foam, emulsion state or a mixture of the same. There can be a carrier fluid supplied along with the additive(s)/chemicals(s) which can be in gaseous, liquid, solid, emulsion state or a mixture of the same. The additives may be added in isolation or along with a carrier fluid. The non limiting examples of the carrier fluid are hydrocarbon liquids of suitable boiling range which may include the feedstock, gas oil, lighter hydrocarbons, residue, solvents, water, steam, nitrogen, inert gases, fuel gas, carbon monoxide, carbon dioxide and/or the like. In case of blockage Steam or Nitrogen or other hydrocarbon gases or liquids like water, naphtha, gasoil, fuel oil, purge oil etc. can be used to clean the injection nozzle.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component of any or all the claims.

While specific language has been used to describe the disclosure, any limitations arising on account of the same are not intended. As would be apparent to a person in the art, various working modifications may be made to the method in order to implement the inventive concept as taught herein.

The invention claimed is:

1. An apparatus for supplying additive (s) into a coker drum, the apparatus comprising:

a. an inlet adapted to supply a hydrocarbon feed stream;

b. a plurality of conduits arranged inside a coker drum, the plurality of conduits being arranged along a vertical height of the coker drum at distinct elevations, each of the plurality of the conduits being provided with an injection nozzle for supplying additives inside the coker drum; and c. an injection control system adapted for:

i. supplying the additive through one or more of the injection nozzles placed within a first predetermined distance in a first-direction from a vapour liquid interphase of the hydrocarbon feed stream supplied to the coke drum, said first direction being along an axial- direction of the coke drum and said first predetermined distance is determined by a function of the distance between two consecutive nozzles at distinct elevations;

ii. discontinuing supply of the additive from a particular injection nozzle when a distance in the first direction between the particular injection nozzle and the vapour-liquid interphase is less than or equal to a second predetermined distance; and iii. supplying steam by one or more of the injection nozzles placed after a third predetermined distance below the vapor liquid interphase in a second direction, the second direction being opposite to the first direction and along the axial direction of the coker drum.

2. The apparatus as claimed in claim 1, wherein the injection control system is further adapted to supply steam into the coker drum via injection nozzles located at a distance greater than the first predetermined distance.

3. The apparatus as claimed in claim 1, wherein the injection control system is further adapted to supply steam into the coker drum via injection nozzles located at a distance less than the second predetermined distance.

4. The apparatus as claimed in claim 1, wherein the number of conduits for supplying additives in the coker drum ranges from 2 to 12.

5. The apparatus as claimed in claim 1, wherein the first predetermined distance is in the range of 0.01-0.8 m from the vapour-liquid interphase.

6. The apparatus as claimed in claim 1, wherein the first predetermined distance is determined by the product of n and the distance between the two consecutive nozzles, wherein n is a multiplication factor.

7. The apparatus as claimed in claim 1, wherein the second predetermined distance is less than 0.01m from a vapour-liquid interphase level.

8. The apparatus as claimed in claim 1, wherein the conduits are placed within a radial distance of 5-30 percent of a radius of the coker drum from the wall of the coker drum.

9. The apparatus as claimed in claim 1, wherein more than one conduit is located at a particular elevation inside the coker drum.

10. The apparatus as claimed in claim 1, wherein the injection control system is further adapted to supply steam into the coker drum via injection nozzles that are not supplying additive at a particular instant of time.

11. The apparatus as claimed in claim 1, further comprising:

a mechanical drive system adapted to move at least one of the plurality of conduits along a vertical height of the coker drum based on the level of the vapour liquid interphase of hydrocarbon feed stream in the coker drum.

12. The apparatus as claimed in claim 11, wherein the mechanical drive system is further adapted to impart a rotatory movement to at least one of the plurality of conduits.

13. The apparatus as claimed in claim 1, wherein the each of plurality of conduits is arranged along a circumference wall of the coker drum.

14. The apparatus as claimed in claim 1, wherein the orientation of an injector nozzle can vary from 45 to 135 degrees to the vertical drum wall.

15. The apparatus as claimed in claim 1, wherein the third predetermined distance is in the range of 0.01m- 0.1m.

* * * * *